US011621495B2

(12) United States Patent
Park et al.

(10) Patent No.: US 11,621,495 B2
(45) Date of Patent: Apr. 4, 2023

(54) ANTENNA DEVICE INCLUDING PLANAR LENS

(71) Applicants: SAMSUNG ELECTRONICS CO., LTD., Suwon-si (KR); KOREA ADVANCED INSTITUTE OF SCIENCE AND TECHNOLOGY, Daejeon (KR)

(72) Inventors: Jaeseok Park, Suwon-si (KR); Rao Shahid Aziz, Daejeon (KR); Youngho Ryu, Suwon-si (KR); Taewan Kim, Daejeon (KR); Seongook Park, Daejeon (KR)

(73) Assignees: SAMSUNG ELECTRONICS CO., LTD., Suwon-si (KR); KOREA ADVANCED INSTITUTE OF SCIENCE AND TECHNOLOGY, Daejeon (KR)

( * ) Notice: Subject to any disclaimer, the term of this patent is extended or adjusted under 35 U.S.C. 154(b) by 0 days.

(21) Appl. No.: 17/268,012

(22) PCT Filed: Aug. 13, 2019

(86) PCT No.: PCT/KR2019/010246
§ 371 (c)(1),
(2) Date: Feb. 11, 2021

(87) PCT Pub. No.: WO2020/036393
PCT Pub. Date: Feb. 20, 2020

(65) Prior Publication Data

US 2021/0184365 A1 Jun. 17, 2021

(30) Foreign Application Priority Data

Aug. 13, 2018 (KR) ..... 10-2018-0094401

(51) Int. Cl.
*H01Q 19/06* (2006.01)
*H01Q 19/04* (2006.01)
(Continued)

(52) U.S. Cl.
CPC ..... *H01Q 19/062* (2013.01); *H01Q 13/085* (2013.01); *H01Q 15/14* (2013.01); *H01Q 21/065* (2013.01)

(58) Field of Classification Search
CPC ..... H01Q 19/062; H01Q 9/0407; H01Q 15/0086; H01Q 15/02; H01Q 15/08;
(Continued)

(56) References Cited

U.S. PATENT DOCUMENTS 10,461,414 B2 * 10/2019 Deng ..... H01Q 25/001
11,233,334 B2 * 1/2022 Ko ..... H01Q 21/061
(Continued)

FOREIGN PATENT DOCUMENTS

CN 106876982 6/2017
CN 107369909 A * 11/2017
(Continued)

OTHER PUBLICATIONS

Teng Li, et al., "Miniaturized Metasurface Unit Cell for Microwave Metalens Antennas", 2017 International Conference on Electromagnetics in Advanced Applications (ICEAA), IEEE, Oct. 2017, 5 pages.
(Continued)

*Primary Examiner* — Vibol Tan
(74) *Attorney, Agent, or Firm* — Nixon & Vanderhye, P.C.

(57) ABSTRACT

According to various embodiments of the present invention, an antenna device can comprise: a substrate layer; a source antenna arranged on the substrate layer so as to include a radiating conductor for radiating electromagnetic waves in the direction in which one surface of the substrate layer is
(Continued)

oriented; and a planar lens for converting quasi-spherical electromagnetic waves radiated from the source antenna into plane waves. The antenna device can be varied according to embodiments.

19 Claims, 7 Drawing Sheets

(51) Int. Cl.
*H01Q 21/06* (2006.01)
*H01Q 13/08* (2006.01)
*H01Q 15/14* (2006.01)

(58) Field of Classification Search
CPC ..... H01Q 1/38; H01Q 15/04; H01Q 21/065; H01Q 1/243; H01Q 1/1257; H01Q 3/46; H01Q 1/3233; H01Q 21/061; H01Q 21/24; H01Q 15/14; H01Q 5/385; H01Q 1/12; H01Q 13/085; G01S 7/03
See application file for complete search history.

(56) References Cited

U.S. PATENT DOCUMENTS

| | | | | |
|---|---|---|---|---|
| 2011/0199273 | A1 | 8/2011 | Kim et al. | |
| 2012/0280872 | A1 | 11/2012 | Werner et al. | |
| 2013/0222200 | A1 | 8/2013 | Ju | |
| 2015/0009080 | A1 | 1/2015 | Oh et al. | |
| 2017/0288316 | A1 | 10/2017 | Chattopadhyay et al. | |
| 2019/0319365 | A1 * | 10/2019 | Kim | H01Q 21/065 |

FOREIGN PATENT DOCUMENTS

| | | | | |
|---|---|---|---|---|
| JP | 2002-228697 | | 8/2002 | |
| JP | 2017-212569 | | 11/2017 | |
| KR | 10-2008-0105398 | | 12/2008 | |
| KR | 10-2010-0046579 | | 5/2010 | |
| KR | 10-2013-0098098 | | 9/2013 | |
| KR | 10-2017-0010777 | | 2/2017 | |
| WO | WO-2013136325 | A1 * | 9/2013 | H01Q 1/38 |
| WO | WO-2016081515 | A1 * | 5/2016 | H01Q 1/246 |
| WO | WO-2020236245 | A1 * | 11/2020 | H01Q 1/243 |

OTHER PUBLICATIONS

International Search Report for PCT/KR2019/010246 dated Nov. 27, 2019, 5 pages.
Written Opinion of the ISA for PCT/KR2019/010246 dated Nov. 27, 2019, 5 pages.
Office Action dated Aug. 21, 2022 in Korean Application No. 10-2018-0094401 and English-language translation.

* cited by examiner

ANTENNA DEVICE INCLUDING PLANAR LENS

This application is the U.S. national phase of International Application No. PCT/KR2019/010246 filed Aug. 13, 2019 which designated the U.S. and claims priority to KR Patent Application No. 10-2018-0094401 filed Aug. 13, 2018, the entire contents of each of which are hereby incorporated by reference.

BACKGROUND

Field

Various embodiments of the disclosure relate to an antenna device, and more particularly, to an antenna device including a planar lens disposed in a radiation direction of an antenna.

DESCRIPTION OF RELATED ART

With the development of wireless communication technology, in recent years, it has come to be possible to watch ultra-high-definition images in real time through a streaming service. For example, early wireless communication services, which provided short message transmission or voice call functions, have gradually developed, and an environment in which large-capacity images can be transmitted and watched in real time is being created. In transmitting such ultra-high-speed and large-capacity information through wireless communication, an antenna device having high gain and power efficiency may be required. For example, an antenna device having low power consumption while having high gain and a sufficient transmission distance may be required.

A reflector, a lens, or the like may be disposed in an antenna device so as to control an oriented direction thereof or a beam width of the antenna device and to suppress a side lobe level of the antenna device, thereby improving gain, transmission distance, power consumption, and the like. When there are few restrictions on the design of an antenna device, such as size, the degree of freedom in designing a reflector or lens is increased, and an antenna device that is sufficiently improved in gain or power consumption, can be manufactured.

SUMMARY

However, higher manufacturing costs may be required in order to satisfy requirements of the antenna device, such as high gain, sufficient transmission distance, and low power consumption thereof. Due to the constraints of the actual installation environment, it may be difficult to manufacture an antenna device in a size suitable for, for example, a user device (e.g., a mobile communication terminal) requiring miniaturization.

Various embodiments of the disclosure are able to provide an antenna device that implements high gain and operates with low power consumption.

Various embodiments of the disclosure are able to provide an antenna device that is characterized by high gain and low power consumption and is easily miniaturized.

According to various embodiments of the disclosure, an antenna device may include: a source antenna including a substrate layer and a radiating conductor disposed on the substrate layer so as to radiate an electromagnetic wave in the direction in which one surface of the substrate layer is oriented; and a planar lens configured to convert a quasi-spherical electromagnetic wave radiated from the source antenna into a plane wave.

According to various embodiments of the disclosure, an antenna device may include: a source antenna including a substrate layer and a radiating conductor disposed on the substrate layer so as to radiate an electromagnetic wave in the direction in which one surface of the substrate layer is oriented; and a planar lens configured to convert a quasi-spherical electromagnetic wave radiated from the source antenna into a plane wave. The planar lens may include: a first dielectric layer including a first metasurface including multiple first unit cells formed of a conductive material, the first dielectric layer being disposed to face the source antenna; and a second dielectric layer including a second metasurface including multiple second unit cells formed of a conductive material, the second dielectric layer being disposed to face the source antenna, with the first dielectric layer interposed therebetween.

Among the first unit cells, the refractive index of a first unit cell, which is positioned in the direction of an angle φ with respect to a normal passing through the radiating conductor when viewed from the radiating conductor, satisfies the conditional expression below.

Conditional Expression $$n(\phi) = n(0) - \frac{\sqrt{d^2 + (d\tan\phi)^2} - d}{t}$$

Here, "n(φ)" may be the refractive index of the first unit cell positioned in the direction of the angle φ, "n(0)" may be a refractive index of a first unit cell positioned on the normal together with the radiating conductor, "d" may be a distance between the substrate layer and the first dielectric layer, and "t" may be a thickness including the thickness of each of the first dielectric layer and the second dielectric layer and the distance between the first dielectric layer and the second dielectric layer.

An antenna device according to various embodiments of the disclosure is able to improve a gain in an oriented direction thereof by converting a quasi-spherical electromagnetic wave into a plane wave using a planar lens including a metasurface. In an embodiment, depending on the shape of a unit cell forming a metasurface, it is possible to suppress a side lobe level, whereby the power efficiency of the antenna device can be improved. In another embodiment, since the planar lens is disposed substantially parallel to the source antenna, it is possible to suppress and mitigate a size increase of the antenna device while improving the gain and power efficiency thereof.

DETAILED DESCRIPTION

Figure 1:
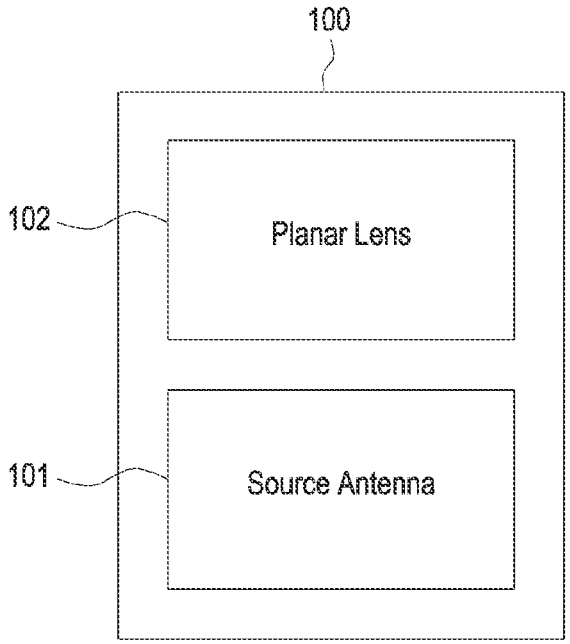
FIG. 1 is a view diagram illustrating the configuration of an antenna device according to various embodiments of the disclosure.

As the disclosure allows for various changes and numerous embodiments, various example embodiments will be described in greater detail with reference to the accompanying drawings. However, it should be understood that the disclosure is not limited to the specific embodiments, and that the disclosure includes all modifications, equivalents, and alternatives within the spirit and the scope of the disclosure.

With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include all possible combinations of the items enumerated together in a corresponding one of the phrases. Although ordinal terms such as "first" and "second" may be used to describe various elements, these elements are not limited by the terms. The terms are used merely to distinguish an element from the other elements. For example, a first element could be termed a second element, and similarly, a second element could be also termed a first element without departing from the scope of the disclosure. As used herein, the term "and/or" includes any and all combinations of one or more associated items. It is to be understood that if an element (e.g., a first element) is referred to, with or without the term "operatively" or "communicatively", as "coupled with," or "connected with,", the element may be coupled with the other element directly (e.g., wiredly), wirelessly, or via a third element.

Further, the relative terms "a front surface", "a rear surface", "a top surface", "a bottom surface", and the like which are described with respect to the orientation in the drawings may be replaced by ordinal numbers such as first and second. In the ordinal numbers such as first and second, their order are determined in the mentioned order or arbitrarily.

In the disclosure, the terms are used to describe specific embodiments, and are not intended to limit the disclosure. As used herein, the singular forms are intended to include the plural forms as well, unless the context clearly indicates otherwise. In the disclosure, the terms such as "include" and/or "have" may be understood to denote a certain characteristic, number, step, operation, constituent element, component or a combination thereof, but may not be construed to exclude the existence of or a possibility of addition of one or more other characteristics, numbers, steps, operations, elements, components or combinations thereof.

Unless defined differently, all terms used herein, which include technical terminologies or scientific terminologies, have the same meaning as that understood by a person skilled in the art to which the disclosure belongs. Such terms as those defined in a generally used dictionary are to be interpreted to have the meanings equal to the contextual meanings in the relevant field of art, and are not to be interpreted to have ideal or excessively formal meanings unless clearly defined in the disclosure.

FIG. 1 is a view illustrating the configuration of an antenna device 100 according to various embodiments of the disclosure.

Referring to FIG. 1, the antenna device 100 may include a source antenna 101 and a planar lens 102. The source antenna 101 may radiate, for example, a quasi-spherical electromagnetic wave using a radiating conductor, and the planar lens 102 may convert the electromagnetic wave (e.g., a quasi-spherical wave) radiated from the source antenna 101 into a plane wave. For example, in the radiation direction of an electromagnetic wave, the planer lens 102 may be disposed substantially parallel to the source antenna 101 in front of the source antenna 101. This will be described in more detail with reference to FIG. 2.

In an embodiment, the radiating conductor of the source antenna 101 may include at least one of a microstrip patch antenna structure, a slot antenna structure, a dipole antenna structure, and a standard horn antenna structure. In an embodiment to be described later, the radiating conductor may have, for example, a patch antenna structure. In another embodiment, the planar lens 102 may include at least one metasurface, and the metasurface may convert a quasi-spherical wave radiated from the source antenna 101 into a planar wave based on a reciprocity theorem.

According to various embodiments, when the planar lens 102 includes multiple metasurfaces, it is possible to improve the performance of the antenna device 100 compared to the case in which only the source antenna 101 is disposed. In an embodiment, the planar lens 102 is able to improve gain in an oriented direction thereof by including a pair of metasurfaces. As will be described below, by disposing the planar lens 102, the gain at the main lobe of the antenna device 100 may be improved by about 7 dB compared to that obtained before the planar lens 102 is disposed.

In another embodiment, by adjusting the position and shape of a unit cell forming the metasurfaces in the planar lens 102, it is possible to suppress a side lobe level of the antenna device 100 while maintaining the gain of the main lobe. For example, it is possible to improve the power efficiency of the antenna device 100 by suppressing the side lobe level while maintaining the communication performance in the oriented direction thereof.

The configuration of the antenna device 100 described above will be described in more detail with reference to FIG.

2. In addition, in describing the configuration of the antenna device 100 with reference to FIG. 2, for some more specific configurations, FIGS. 3 and 4 may be further referred to as necessary. In describing various embodiments, for configurations that are the same as or similar to those disclosed in the preceding embodiments or the drawings thereof, the same reference numerals may be used, or the reference numerals may be omitted, and detailed descriptions thereof may also be omitted.

Figure 2:
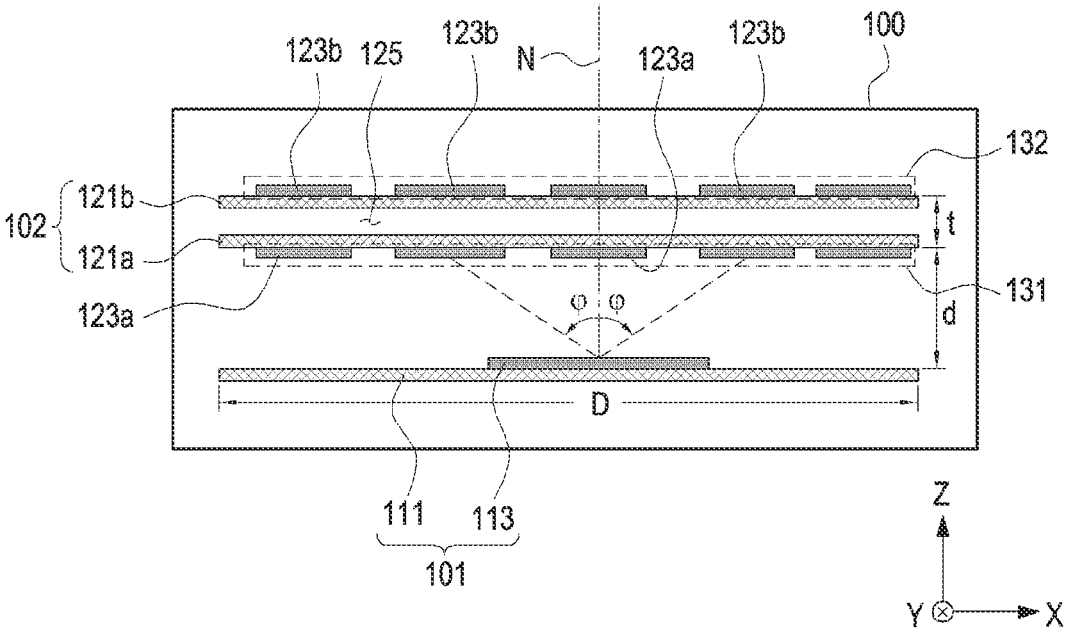
FIG. 2 is a side view illustrating an antenna device according to various embodiments of the disclosure.
Figure 3:
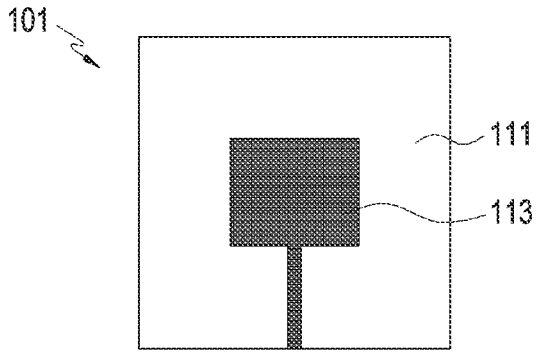
FIG. 3 is a plan view illustrating a source antenna in an antenna device according to various embodiments of the disclosure.
Figure 4:
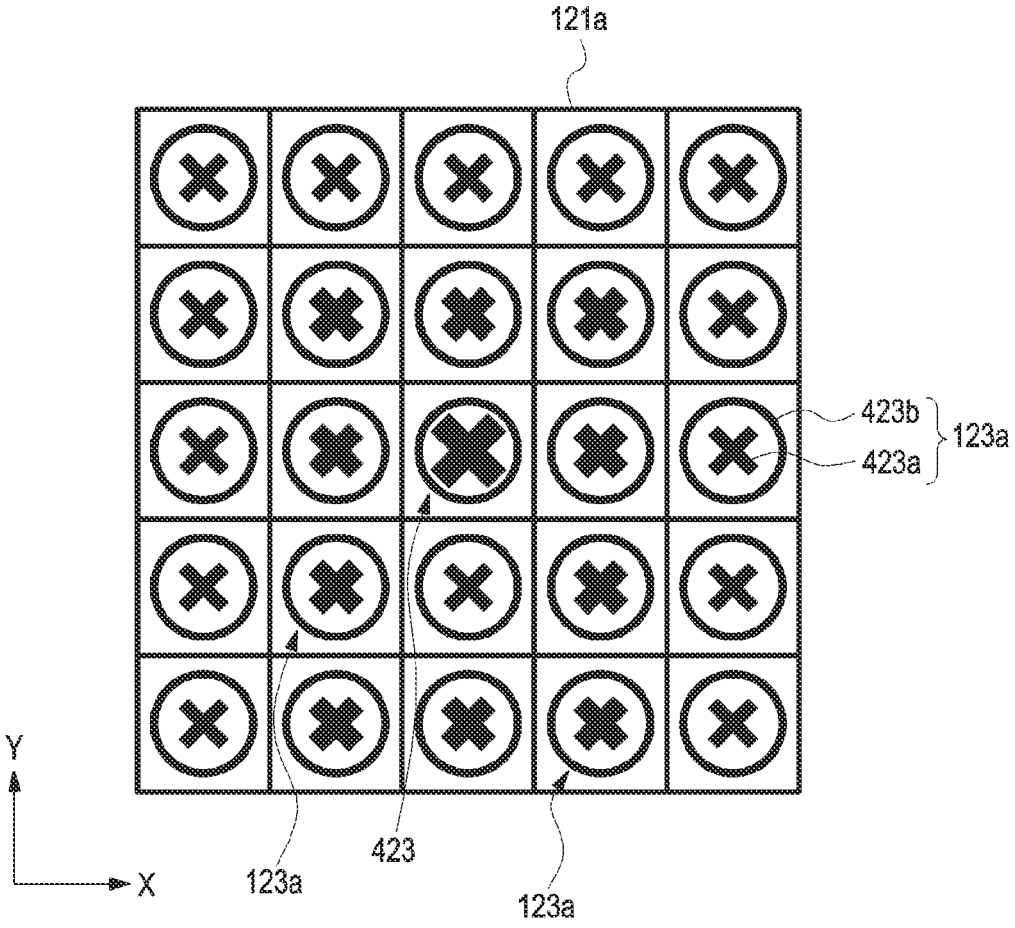
FIG. 4 is a plan view illustrating a first dielectric layer of a planar lens in an antenna device according to various embodiments of the disclosure.

FIG. 2 is a side view illustrating an antenna device 100 according to various embodiments of the disclosure. FIG. 3 is a plan view illustrating a source antenna 102 in the antenna device 100 according to various embodiments of the disclosure. FIG. 4 is a plan view illustrating a first dielectric layer 121*a* of a planar lens 102 in the antenna device 100 according to various embodiments of the disclosure.

Referring to FIG. 2, the antenna device 100 may include, in combination, a source antenna including a substrate layer 111 and a radiating conductor 113 (e.g., the source antenna 101 in FIG. 1), and a planar lens (e.g., the planar lens 101 in FIG. 1) including multiple (e.g., a pair of) dielectric layers 121*a* and 121*b* on which multiple unit cells 123*a* and 123*b*) are disposed, respectively (e.g., the planar lens 101). In an embodiment, the unit cells 123*a* and 123*b* may form metasurfaces 131 and 132 on the dielectric layers 121*a* and 121*b*, respectively.

Referring to FIGS. 2 and 3, the source antenna 101 may include a substrate layer 111 and a radiating conductor 113 configured to radiate an electromagnetic wave in a direction in which one surface (e.g., the top surface in FIG. 2) of the substrate layer 111 is oriented. In an embodiment, the radiating conductor 113 may be formed as a printed circuit pattern (e.g., a microstrip) disposed on the surface of the substrate layer 111 or buried in the substrate layer 111. In another embodiment, the radiating conductor 113 or the printed circuit pattern forming the radiation conductor 113 may include at least one of a patch antenna structure, a slot antenna structure, a dipole antenna structure, or a standard horn (standard). Although not illustrated, a ground plane configured to provide reference potential or an integrated circuit chip configured to supply power or a wireless signal to the radiating conductor 113 may be disposed on the substrate layer 111. In another embodiment, the radiating conductor 113 may be provided with a feeding signal or the like via the integrated circuit chip disposed on the substrate layer 111 or electrically connected to the substrate layer 111, and may radiate a quasi-spherical wave.

Referring to FIGS. 2 and 4, the planar lens 102 may include a first dielectric layer 121*a* disposed to face the source antenna 101, and a second dielectric layer 121*a* disposed to face the source antenna 101, with the first dielectric layer 121*a* interposed therebetween. According to an embodiment, the first dielectric layer 121*a* may include multiple first unit cells 123*a* and 423 formed of a conductive material. The first unit cells 123*a* and 423 may be arranged in, for example, a 5*5 matrix form, and the number and arrangement form thereof may vary according to embodiments. One of the first unit cells 123*a* and 423 (e.g., the first unit cell denoted by reference numeral "423") may be disposed on a normal passing through the radiating conductor 113 (e.g., the normal N in FIG. 2) to directly face the radiating conductor 113. In an embodiment, the first unit cells 123*a* and 423 may be disposed on one surface of the first dielectric layer 121*a* to face the source antenna 101 and to form a first metasurface 131 on the one surface of the first dielectric layer 121*a*. In the following detailed description, the "first unit cell(s)" will be generally described with reference numeral "123*a*", but a "first unit cell disposed on the normal N" may be denoted by reference numeral "423" if necessary, and may be referred to as a "first unit cell serving as a reference".

According to various embodiments, some of the first unit cells 123*a* and 423 may have a phase shift angle different from those of the remaining ones. For example, some of the first unit cells 123*a* and 423 may have a shape or size different from the remaining ones. In FIG. 4, the first unit cells 123*a* and 423 may include a first conductor pattern 423*a* having an approximate cross shape, and a second conductor pattern 423*b* formed to surround at least a portion of the region in which the first conductor pattern 423*a* is formed. According to an embodiment, the sizes of the first conductor patterns 423*a* may be different from each other depending on the positions of the first unit cells 123*a* and 423. For example, the first conductor pattern 423*a* of the first unit cell (e.g., the first unit cell 423 serving as a reference) positioned in the center on one surface of the first dielectric layer 121*a* may have a greater width or length than the first conductor pattern 423*a* of other unit cells 123*a*. In an embodiment, the first unit cells 123*a* arranged along an edge on one surface of the first dielectric layer 121*a* have the same shape and size, but may include a first conductor pattern 423*a* having a size smaller than those of the remaining first unit cells 123*a* and 423.

According to various embodiments, the first unit cells 123*a* and 423 described above or the second unit cells 123*b* to be described later may have different refractive indices for an incident electromagnetic wave depending on the shapes or sizes thereof, and may thus change the phase of an incident electromagnetic wave. For example, by appropriately arranging the unit cells described above (e.g., the first unit cells 123*a* and 423) or the second unit cells 123*b* to be described later, the antenna device 100 (or the planar lens 102) may include a metasurface(s), and the metasurface(s) described above may convert a quasi-spherical wave radiated from the source antenna 101 into a plane wave so that the gain, the side lobe, or the like of the antenna device 100 can be improved.

According to various embodiments, the second dielectric layer 121*b* may include multiple second unit cells 123*b* formed of a conductive material. The second unit cells 123*b* may be disposed on one surface of the second dielectric layer 121*b* so as to form a second metasurface 132. For example, the second unit cells 123*b* may form the second metasurface 132 in a direction facing away from the source antenna. According to an embodiment, each of the second unit cells 123*b* may be positioned to correspond to one of the first unit cells 123*a*. For example, one of the second unit cells 123*b* may be disposed on the normal N together with the radiation conductor 113 or the first unit cell 423 serving as a reference. Since the shape and arrangement of the second unit cells 123*b* may be substantially the same as those of the first unit cells 123*a*, a detailed description thereof will be omitted.

According to various embodiments, the planar lens 102 may further include an air gap 125. For example, the first dielectric layer 121*a* and the second dielectric layer 121*b* may be disposed with a predetermined distance therebetween, and the air layer 125 may be disposed between the first dielectric layer 121*a* and the second dielectric layer 121*b*.

In some embodiments, the planar lens 102 may be disposed at an appropriate distance d (generally, a "focal length") from the source antenna 101 so as to convert a quasi-spherical wave generated through the radiating conductor 113 into a plane wave. According to an embodiment, assuming that the source antenna 101 (e.g., the substrate layer 111) has a flat plate shape having a diameter D, the ratio of the diameter D to the distance d may satisfy the range of 2 to 3 inclusive. For example, the planar lens 102 may be located at a distance d of approximately D/2.25 from the source antenna 101. As will be described later, a sample having a source antenna having a diameter D of 51.7 mm and a planar antenna disposed at a distance d of 20 to 25 mm from the source antenna was fabricated, and the performance or the like of an antenna device according to various embodiments (e.g., the antenna device (100)) was measured. In some embodiments, the source antenna 101 may have a square shape having a side length of D.

According to various embodiments, as illustrated in FIG. 2, unit cells (e.g., the first unit cells 123*a* and 423 forming the first metasurface 131 or the second metasurface 132 may have different positions relative to the radiating conductor 113. Accordingly, respective unit cells have different refractive indices with respect to an incident electromagnetic wave depending on the relative positions thereof, so that the planar lens 102 can convert a quasi-spherical wave into a plane wave. According to an embodiment, in order to form a metasurface (e.g., the first metasurface 131 or the second metasurface 132), each unit cell may have a refractive index that satisfies the following Equation 1 for an incident electromagnetic wave.

$$n(r) = n(0) - \frac{\sqrt{d^2 + r^2} - d}{t} \qquad \text{Equation 1}$$

Here, "n(0)" is a refractive index of a first unit cell positioned on the normal N together with the radiating conductor 113, for example, the first unit cell 423 serving as a reference, "n(r)" is a refractive index of a first unit cell 123*a* disposed on the first metasurface 131 at a position spaced apart from the first unit cell 423 serving as a reference by a distance r, "d" is a distance between the source antenna 101 (e.g., the substrate layer 111) and the planar antenna 102 (e.g., the first dielectric layer 121*a*), and "t" is the thickness of the planar lens 102, and means, for example, the sum of the thicknesses of the first dielectric layer 121*a*, the second dielectric layer 121*b*, and the air layer 125.

According to an embodiment, when the first unit cell 123*a* at the position spaced apart from the first unit cell 423 serving as a reference by the distance r is positioned in the direction of an angle φ with respect to the normal N when viewed from the radiating conductor 113, the distance r can be calculated as d*tan φ. For example, each unit cell (e.g., the first unit cell 123*a*) may have a refractive index that satisfies the following Equation 2 for an incident electromagnetic wave.

$$n(\phi) = n(0) - \frac{\sqrt{d^2 + (d\tan\phi)^2} - d}{t} \qquad \text{Equation 2}$$

Here, "n(φ)" means the refractive index of the first unit cell 123*a* positioned in the direction of the angle φ, and the refractive index of the unit cell serving as a reference (e.g., the first unit cell 423) may be "1" for an incident electromagnetic wave when the unit cell has an ideal planar lens or a metasurface. For example, in an ideal planar lens, "n(0)" may be "1" in Equation 1 or Equation 2, and therefore, each unit cell positioned in the direction of angle φ may have a refractive index that satisfies the following Equation 3.

$$n(\phi) = 1 - \frac{\sqrt{d^2 + (d\tan\phi)^2} - d}{t} \qquad \text{Equation 3}$$

For example, in order to satisfy a condition required for the antenna device 100, for example, to implement a planar lens that converts a quasi-spherical wave into a plane wave, the refractive indices or phases of respective unit cells for an incident electromagnetic wave may be determined differently from each other depending on the positions of the unit cells. The required conditions for such refractive indices may be satisfied according to S-parameters of respective unit cells. For example, the refractive indices of respective unit cells may satisfy the following Equation 4.

$$n(\phi) = \frac{1}{k_0 t}\left[\mathrm{Re}\left\{\ln\left(X \pm j\sqrt{1 - X^2}\right)\right\} - j\mathrm{Im}\left\{X \pm j\sqrt{1 - X^2}\right\}\right] \qquad \text{Equation 4}$$

Here, "$k_0$" is a wavenumber calculated based on an operating frequency f and the speed of light c, and is $$k_0 = \frac{2\pi f}{c},$$

and "X" is a value calculated based on the S-parameter of a unit cell, and is $$X = \frac{1}{2S_{21}\left(1 - S_{11}^2 + S_{21}^2\right)}.$$

Figure 5:
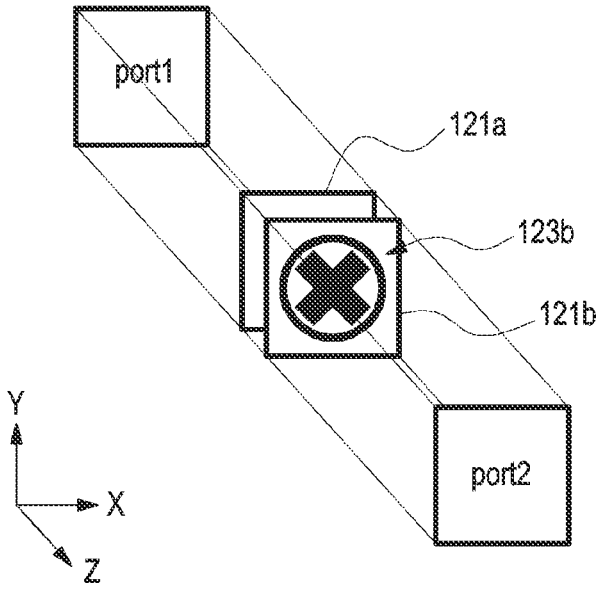
FIG. 5 is a view for describing a design environment of a unit cell in an antenna device according to various embodiments of the disclosure.

S-parameters of the unit cells are determined to satisfy Equation 4, and respective unit cells may be designed or fabricated based on these S-parameters. When the S-parameters are determined, the unit cells may be designed or manufactured under periodic boundary conditions satisfying the following Equations 5, 6, and 7. FIG. 5 is a view for describing a design environment of a unit cell in an antenna device according to various embodiments of the disclosure, and illustrates the configuration of a measurement environment or a simulation environment to which boundary conditions according to Equations 5, 6, and 7 are assigned.

$$Z = \pm\sqrt{\frac{(1 + S_{11})^2 - S_{21}^2}{(1 - S_{11})^2 - S_{21}^2}} \qquad \text{Equation 5}$$

$$e^{in(\phi)k_0 t} = X \pm i\sqrt{1 - X^2} \qquad \text{Equation 6}$$

$$k_0 = \frac{2\pi f}{c} \qquad \text{Equation 7}$$

According to various embodiments, in the planar lens 102, for example, in the first metasurface 131 or the second metasurface 132, each of the refractive indices of the unit cells (e.g., the first unit cell 123*a* and the second unit cell 123*b* in FIG. 2) included in respective metasurfaces 131 and 132 can be determined based on Equations 1, 2, and 3 described above, and then the S-parameters satisfying the refractive indices of respective unit cells can be calculated based on Equation 4. The shapes or sizes of the unit cells that satisfy the calculated S-parameters can be designed or fabricated under boundary conditions based on Equations 5, 6, and 7.

In another embodiment, in the state in which unit cells having different S-parameters are designed or fabricated first, the planar lens of the antenna device 100 (e.g., the planar lens 102 in FIG. 2) may be designed. "Designing a planar lens" may mean including a process of determining the refractive index of each unit cell forming the metasurface. For example, when designing a planar lens, the refractive index of each individual unit cell may be determined according to a condition required for the antenna device 100. When the refractive index of each individual unit cell forming the metasurface is determined, unit cells that satisfy the refractive indices to be determined are selected from among prefabricated unit cells (e.g., unit cells having different S-parameters), and may be arranged on a planar lens or a dielectric layer (e.g., the first dielectric layer 121*a* or the second dielectric layer 121*b* in FIG. 2) so as to form a metasurface.

With respect to the antenna device completed through this process, a performance measurement may be performed in order to determine whether the performance of the initially designed antenna device is satisfied. In an embodiment, as a result of the performance measurement, when the required conditions or performance are not satisfied, the process of designing, fabricating, or modifying the antenna device as described above may be repeated until the performance required for the antenna device is satisfied.

Figure 6:
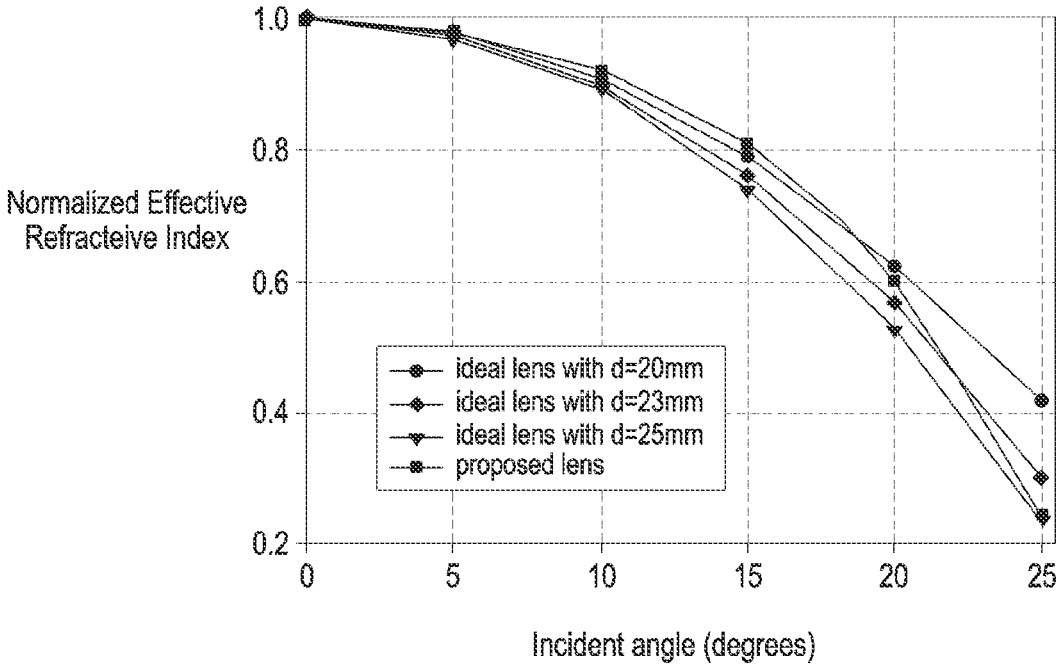
FIG. 6 is a graph showing refractive indices of unit cells depending on the distance between a source antenna and a planar lens in an antenna device according to various embodiments of the disclosure.

FIG. 6 is a graph showing refractive indices of unit cells depending on the distance between a source antenna and a planar lens in an antenna device (e.g., the antenna device 100 in FIG. 2) according to various embodiments of the disclosure.

Further referring to FIG. 4 in addition to FIG. 6, among the unit cells (e.g., the first unit cells 123*a* and 423), with reference to the first unit cell 423 serving as a reference, the remaining first units 123*a* may be arranged around the first unit cell 423 so as to form the above-described metasurfaces (e.g., the first metasurface 131 and the second metasurface 132 in FIG. 2). In an embodiment, the first unit cell 423 serving as a reference, and the first unit cell(s) 123*a* arranged along the edges of the metasurfaces 131 and 132 may have different phase shift angles. In another embodiment, another first unit cell(s) 123*a* arranged to be substantially in contact with the first unit cell 423 serving as a reference may have another phase shift angle.

The phase shift angle distribution of the metasurface or planar lens (e.g., the planar lens 102 in FIG. 2) completed by a combination of unit cells having phase shift angle characteristics as described above may have a parabolic profile that satisfies the following Equation 8.

$$\Phi(x, y) = \frac{2\pi}{\lambda}\left(\sqrt{x^2 + y^2 + d^2} - d\right) + \Phi_0 \qquad \text{Equation 8}$$

Here, "Φ(x, y)" is the phase shift angle of the first unit cell 123*a* positioned at a distance x and a distance y from the origin, "λ" is the wavelength of an operating frequency f, "d" denotes the distance between the substrate layer 111 and the first dielectric layer 121*a*, and "Φ0" denotes the phase shift angle of the first unit cell 423 serving as a reference.

In addition, in Equation 8, the term "origin" may mean the origin of an orthogonal coordinate system formed in a plane in which the first unit cells 123*a* and 423 are arranged in FIG. 4. In this embodiment, the origin may mean a point where the first unit cell 423 serving as a reference is positioned. In addition, "distance x" may be the distance from the origin to the designated unit cell in the horizontal-axis (X) direction in the Cartesian coordinate system, and "distance y" may be the distance from the origin to a designated unit cell in the vertical-axis (Y) direction in the Cartesian coordinate system. According to an embodiment, "$\sqrt{x^2+y^2+d^2}$" may be substantially a linear distance from the radiating conductor (e.g., the radiating conductor 113 in FIG. 2) to a designated unit cell.

Figure 7:
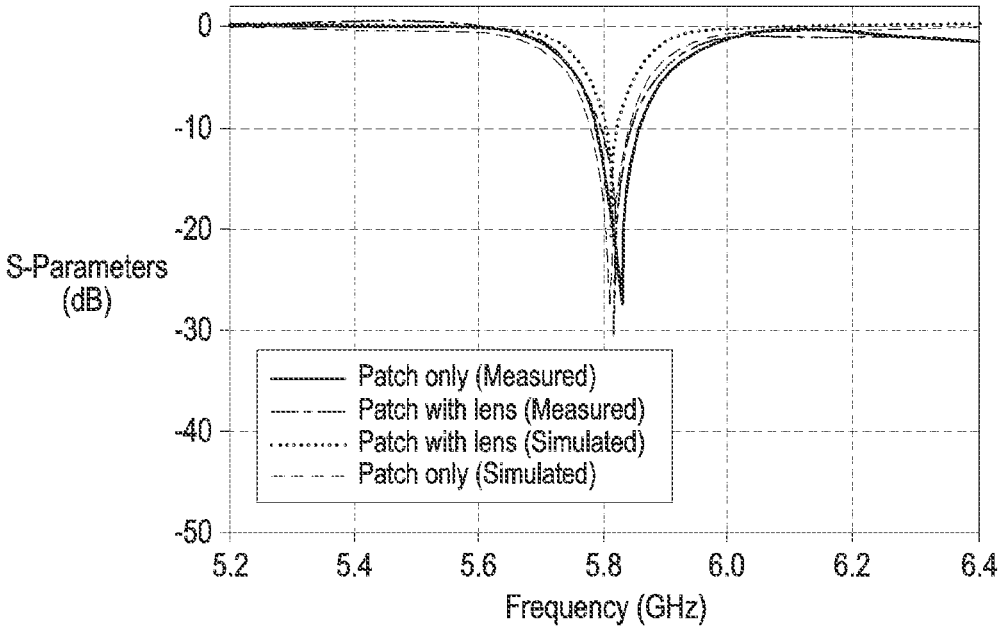
FIG. 7 is a graph showing S parameters of an antenna device according to various embodiments of the disclosure measured before and after a planar lens is disposed.
Figure 8:
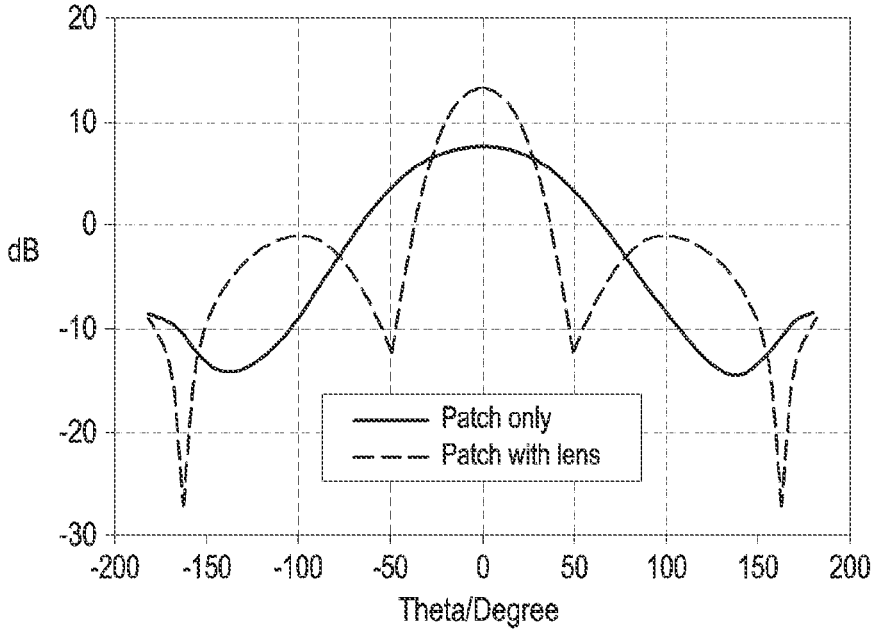
FIG. 8 is a graph showing E-plane radiation patterns of an antenna device according to various embodiments of the disclosure before and after a planar lens is disposed.
Figure 9:
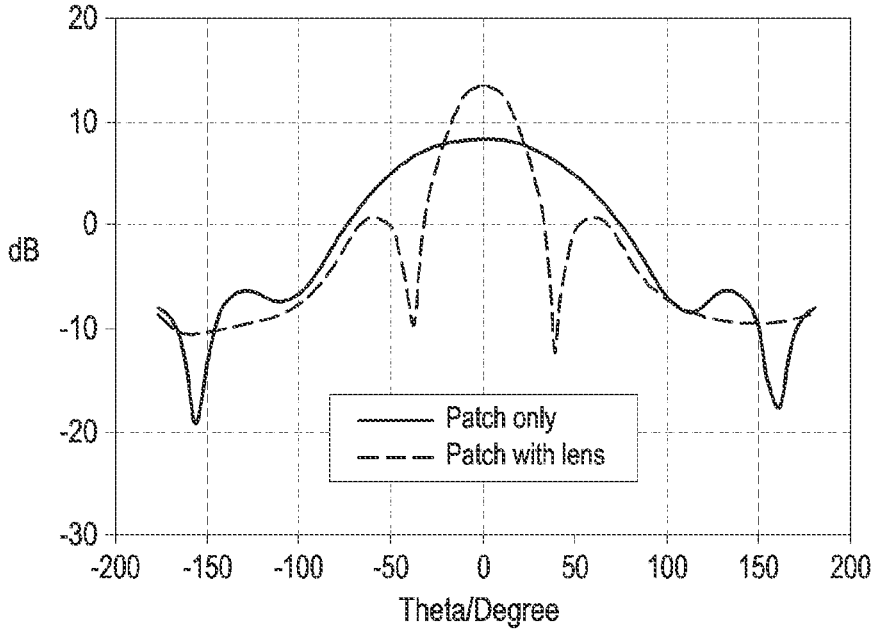
FIG. 9 is a graph showing H-plane radiation patterns of an antenna device according to various embodiments of the disclosure before and after a planar lens is disposed.

FIG. 7 is a graph showing S parameters of an antenna device (e.g., the antenna device 100 in FIG. 2) according to various embodiments of the disclosure measured before and after a planar lens (e.g., the planar lens 102 in FIG. 2) is disposed. FIG. 8 is a graph showing E-plane radiation patterns of an antenna device (e.g., the antenna device 100 in FIG. 2) according to various embodiments of the disclosure before and after a planar lens (e.g., the planar lens 102 in FIG. 2) is disposed. FIG. 9 is a graph showing H-plane radiation patterns of an antenna device (e.g., the antenna device 100 in FIG. 2) according to various embodiments of the disclosure before and after a planar lens (e.g., the planar lens 102 in FIG. 2) is disposed.

Referring to FIG. 7, it can be seen that there is no significant change in S-parameters, e.g., reflection coefficients, before and after a planar lens (e.g., the planar lens 102 in FIG. 2) is disposed. For example, the effect of the planar lens 102 on the operating frequency of the antenna device (e.g., the antenna device 100 in FIG. 2) may be insignificant. According to an embodiment, as shown in FIGS. 8 and 9, by disposing the planar lens 102, the gain in the main lobe can be improved by about 7 dB. This is obtained by measuring the performance of an antenna device designed such that the ratio of the distance between the source antenna 101 and the planar lens 102 (e.g., the first dielectric layer 121*a*) to the diameter D of the source antenna 101 is 0.44 (e.g., D=51.7mm and d=23 mm).

Meanwhile, as shown in FIG. 8, it can be seen that in the radiation pattern of the E-plane, the side lobe level increases to a maximum of 14 dB by disposing the planar lens 102. Such an increase in the level of the side lobe may cause interference with other electronic components or communication devices (e.g., antennas), and may reduce the power efficiency of the antenna device 100. The increase in the level of the side lobe can be suppressed by adjusting the phase distribution or the amplitude distribution for respective regions of the metasurface. For example, referring again to FIG. 4, when the region in which the first unit cell 423 serving as a reference is disposed is referred to as a first region, a region in which first unit cells 123*a*, which are substantially in contact with the first unit cell 423 serving as a reference, are disposed is referred to as a second region, and a region in which the first unit cells 123*a* are arranged along an edge of a metasurface is referred to as a third region, it is possible to suppress an increase in the side lobe level by adjusting the phase distribution or amplitude distribution of the unit cells in the first to third regions. The shapes of the unit cells (e.g., the first unit cells 123*a* and 423*a* in FIG. 4) may be changed in order to adjust the phase distribution or amplitude distribution.

Figure 10:
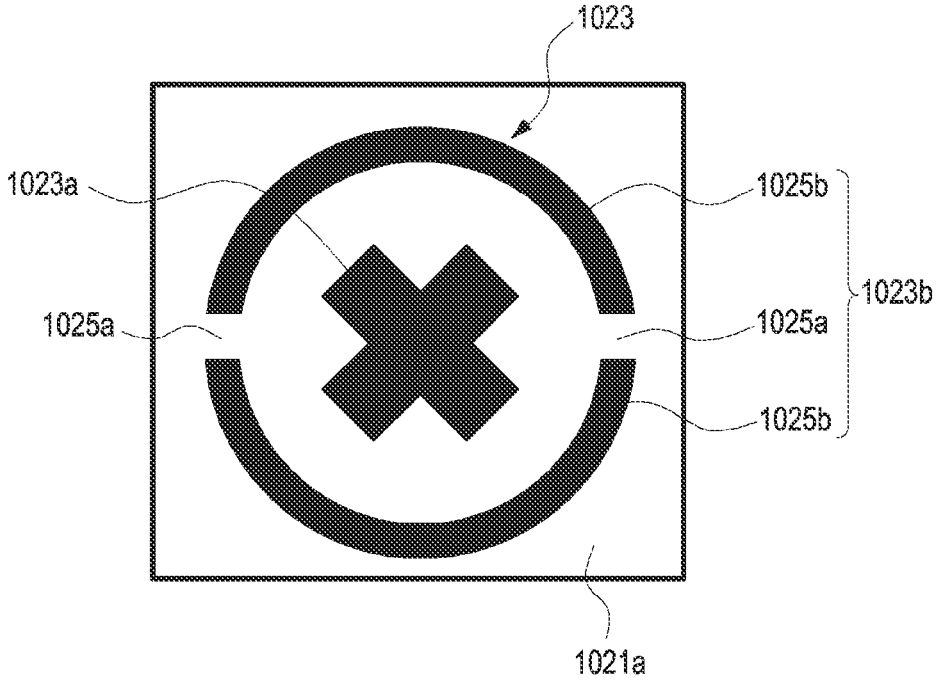
FIG. 10 is a plan view illustrating a modification of a unit cell in an antenna in an antenna device according to various embodiments of the disclosure.

FIG. 10 is a plan view illustrating a modification 1023 of a unit cell (e.g., the first unit cell 123*a* or 423 in FIG. 4) in an antenna device (e.g., the antenna device 100 in FIG. 2) according to various embodiments of the disclosure.

The first unit cells 123*a* and 423 in FIG. 4 may have a shape in which the second conductor pattern 423*b* generally forms a closed curve. According to an embodiment, the unit cells may be modified in order to adjust the phase distribution or the amplitude distribution in the first region, the second region, or the third region of the metasurface. Referring to FIG. 10, the unit cell 1023 formed on the dielectric layer 1021*a* (e.g., the first dielectric layer 121*a* or the second dielectric layer 121*b* in FIG. 2) may include a first conductor pattern 1023*a* and a second conductor pattern 1023*b* surrounding at least a portion of the region in which the first conductor pattern 1023*a* is formed. According to an embodiment, the second conductor pattern 1023*b* may include one or more slots 1025*a* and one or more conductor portions 1025*b*, and the slots 1025*a* and the conductor portions 1025*b* may be arranged along a closed curve trajectory surrounding the region in which the first conductor pattern 1023*a* is formed. When multiple slots 1025*a* and multiple conductor portions 1025*b* are formed, the slots and the conductor portions may be alternately arranged. In FIG. 10, a gap of about 0.5 mm may be formed between one end of a conductor portion 1025*b* and an end of a conductor portion 1025*b* adjacent thereto. For example, the width of the slots 1025*a* may be about 0.5 mm.

According to various embodiments, the unit cell 1023 may replace at least one of the first unit cells 123*a* and 423 of FIG. 4. For example, if it is desired to adjust the phase distribution or the amplitude distribution in the second region, the first unit cell 123*a*, which is substantially in contact with the first unit cell 423 serving as a reference, may be replaced by the unit cell 1023 of FIG. 10. The region or unit cell in which it is desired to adjust the phase distribution or the amplitude distribution may be appropriately selected according to the operating characteristics of the fabricated antenna device (e.g., radiation patterns in the E plane or H plane). It is noted that the shape or positional relationship of the first conductor pattern 1023*a* or the second conductor pattern 1023*b* disclosed in this embodiment does not limit the disclosure. For example, the shape of the first conductor pattern 1023*a* or the second conductor pattern 1023*b*, or the number of slots 1025*a* or conductor portions 1025*b* may be designed or fabricated in various ways in consideration of the phase distribution or the amplitude distribution of a desired region.

Figure 11:
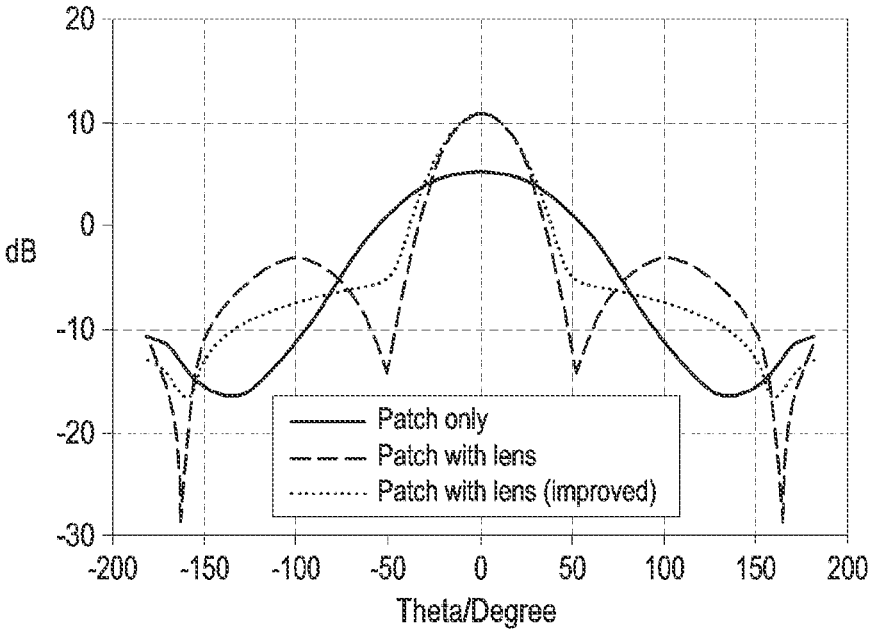
FIG. 11 is a graph showing E-plane radiation patterns before and after a unit cell is modified in an antenna device according to various embodiments of the disclosure.
Figure 12:
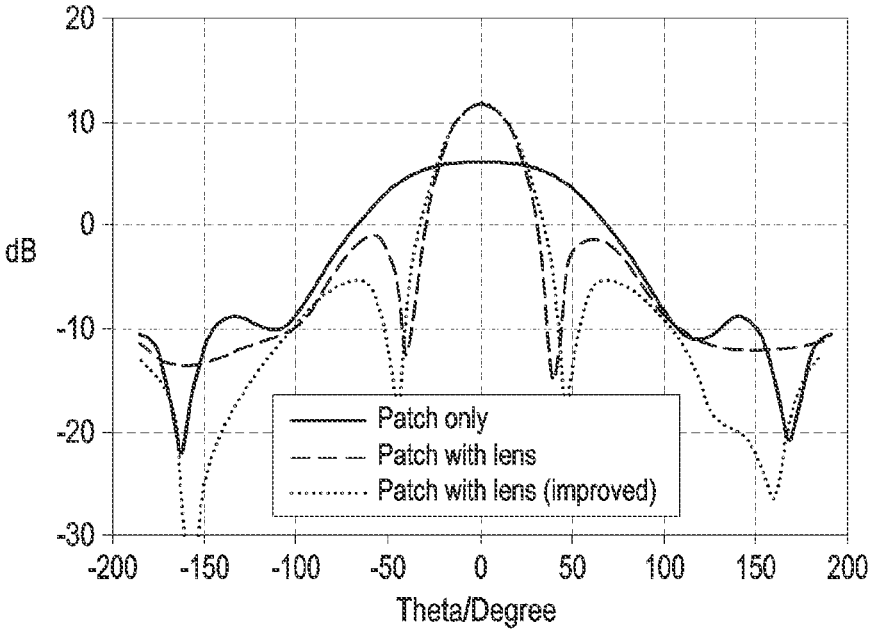
FIG. 12 is a graph showing H-plane radiation patterns before and after a unit cell is modified in an antenna device according to various embodiments of the disclosure.
Figure 13:
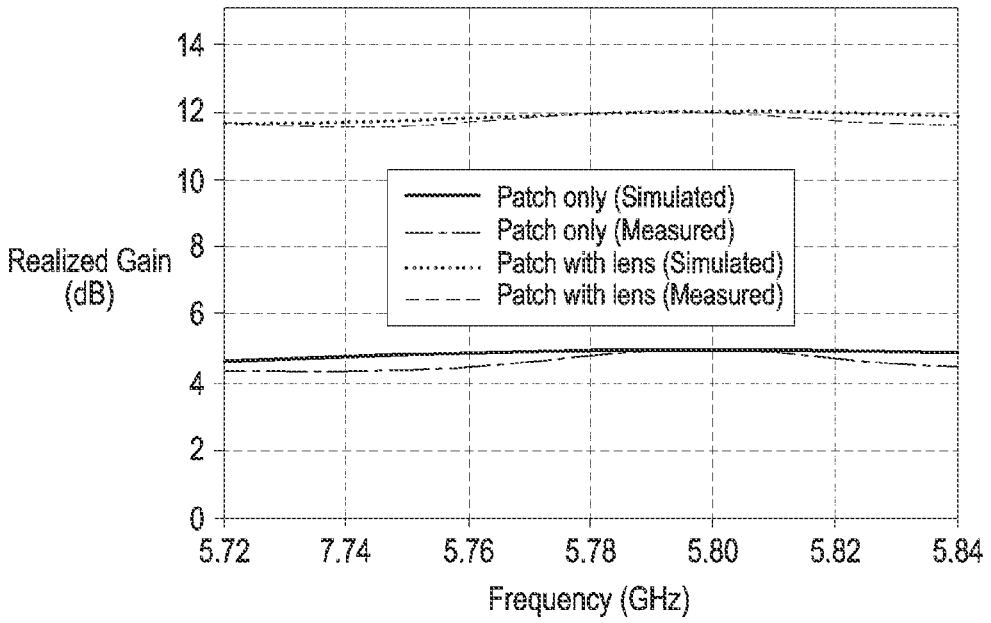
FIG. 13 is a graph showing gains measured before and after a planar lens is disposed in an antenna device according to various embodiments of the disclosure.

FIG. 11 is a graph showing E-plane radiation patterns before and after a unit cell is modified in an antenna device (e.g., the antenna device 100 in FIG. 2) according to various embodiments of the disclosure. FIG. 12 is a graph showing H-plane radiation patterns before and after a unit cell is modified in an antenna device (e.g., the antenna device 100 in FIG. 2) according to various embodiments of the disclosure. FIG. 13 is a graph showing gains measured before and after a planar lens is disposed in an antenna device (e.g., the antenna device 100 in FIG. 2) according to various embodiments of the disclosure.

According to various embodiments, by replacing the first unit cell 1023 of FIG. 10, for example, the first unit cell disposed in the second region in FIG. 4 (e.g., the first unit cell 123*a*, which is disposed to be substantially in contact with the first unit cell 423 serving as a reference), it is possible to adjust the phase distribution or the amplitude distribution, whereby it is possible to suppress an increase in the side lobe level. Referring to FIGS. 11 and 12, it can be seen that by optimizing the phase distribution or the amplitude distribution in a selected region of the metasurface using a modified unit cell (e.g., the unit cell 1023 in FIG. 10), the side lobe level and the half-power beam width are improved. For example, it was confirmed that by optimizing the phase distribution or the amplitude distribution in a selected region of the metasurface, the side lobe level was improved by up to 25 dB, the half-length beam width in the E plane was reduced from 94 degrees to 37 degrees, and the half-length beam width in the H plane was reduced from 93 degrees to 38 degrees.

In addition, as shown in FIG. 13, it can be seen that by disposing the planar lens (e.g., the planar lens 102 in FIG. 2), the gain of the antenna device (e.g., the antenna device 100 in FIG. 2) is improved by about 7 dB. For example, the antenna device 100 according to various embodiments of the disclosure is capable of improving the gain in the main lobe using the planar lens 102 and of improving power efficiency or directivity by optimizing the phase distribution or the amplitude distribution using the unit cells (e.g., the first unit cell 123*a* and the second unit cell 123*b* in FIG. 2) of the planar lens 102.

As described above, according to various embodiments of the disclosure, an antenna device (e.g., the antenna device 100 in FIG. 2) may include a substrate layer (e.g., the substrate layer 111 in FIG. 2), a source antenna (e.g., the source antenna 101 in FIG. 2) including a radiating conductor (e.g., the radiating conductor 113 in FIG. 2) disposed on the substrate layer to radiate an electromagnetic wave in the direction in which one surface of the substrate layer is oriented, and a planar lens (e.g., the planar lens 102 in FIG. 2) configured to convert a quasi-spherical electromagnetic wave radiated from the source antenna into a plane wave.

According to various embodiments, the planar lens may include: a first dielectric layer (e.g., the first dielectric layer 121*a* in FIG. 2) including multiple first unit cells (e.g., the first unit cells 123*a* in FIG. 2) formed of a conductive material, the first dielectric layer being disposed to face the source antenna; and a second dielectric layer (e.g., the second dielectric layer 121*b* in FIG. 2) including multiple second unit cells (e.g., the second unit cells 123*b* in FIG. 2) formed of a conductive material, the second dielectric layer being disposed to face the source antenna, with the first dielectric layer interposed therebetween.

According to various embodiments, the planar lens may further include an air gap (e.g., the air gap 125 in FIG. 2) formed between the first dielectric layer and the second dielectric layer.

According to various embodiments, the first unit cells may be disposed on a surface of the first dielectric layer that faces the source antenna so as to form a metasurface (e.g., the first metasurface 131 in FIG. 2).

According to various embodiments, the second unit cells may be disposed on a surface of the second dielectric layer that faces away from the source antenna so as to form a metasurface (e.g., the second metasurface 132 in FIG. 2).

According to various embodiments, each of the second unit cells may be disposed to correspond to one of the first unit cells.

According to various embodiments, among the first unit cells, a refractive index of a first unit cell, which is positioned in a direction of an angle φ with respect to a normal (e.g., the normal N in FIG. 2) passing through the radiating conductor when viewed from the radiating conductor, satisfies the conditional expression below.

$$n(\phi) = n(0) - \frac{\sqrt{d^2 + (d\tan\phi)^2} - d}{t} \qquad \text{Conditional Expression}$$

Here, "n(φ)" may be the refractive index of the first unit cell positioned in the direction of the angle φ, "n(0)" may be a refractive index of a first unit cell positioned on the normal together with the radiating conductor, "d" may be the distance between the substrate layer and the first dielectric layer, and "t" may be a thickness including a thickness of each of the first dielectric layer and the second dielectric layer and a distance between the first dielectric layer and the second dielectric layer.

According to various embodiments, among the first unit cells, a refractive index of a first unit cell, which is positioned in a direction of an angle φ with respect to a normal passing through the radiating conductor when viewed from the radiating conductor, satisfies the following Conditional Expression.

$$n(\phi) = \frac{1}{k_0 t}\left[\mathrm{Re}\left\{\ln\left(X \pm j\sqrt{1-X^2}\right)\right\} - j\mathrm{Im}\left\{X \pm j\sqrt{1-X^2}\right\}\right] \quad \text{Conditional Expression}$$

Here, "$k_0$" is a wavenumber calculated based on an operating frequency f and the speed of light c, and is $$k_0 = \frac{2\pi f}{c},$$

"X" is a value calculated based on an S-parameter of the first unit cell, and is $$X = \frac{1}{2S_{21}\left(1 - S_{11}^2 + S_{21}^2\right)}.$$

According to various embodiments, at least some of the first unit cells may have a phase different from those of remaining first unit cells.

According to various embodiments, in an orthogonal coordinate system, which is formed in a plane in which the first unit cells are arranged, and at an origin of which a first unit cell serving as a reference is located, a first unit cell positioned at a distance x from the origin in a horizontal-axis direction and a distance y from the origin in a vertical-axis direction has a phase that satisfies the conditional expression below, and the first unit cell serving as a reference may be positioned on a normal passing through the radiating conductor.

$$\Phi(x, y) = \frac{2\pi}{\lambda}\left(\sqrt{x^2 + y^2 + d^2} - d\right) + \Phi_0 \quad \text{Conditional Expression}$$

Here, "Φ(x, y)" may be a phase shift angle of the first unit cell 123*a* positioned at the distance x and the distance y from the origin, "λ" may be a wavelength of an operating frequency f, "d" may be a distance between the substrate layer and the first dielectric layer, and "$\Phi_0$" may be a phase shift angle of the first unit cell serving as a reference.

According to various embodiments, the radiating conductor may include at least one of a microstrip patch antenna structure, a slot antenna structure, a dipole antenna structure, and a standard horn antenna structure.

According to various embodiments, the substrate layer may have a circular or square shape, and when the diameter or the length of the side of the substrate layer is D, the distance d between the substrate layer and the planar lens may satisfy the conditional expression below.

$$2 \le D/d \le 3 \quad \text{Conditional Expression}$$

According to various embodiments of the disclosure, an antenna device may include: a source antenna including a substrate layer and a radiating conductor disposed on the substrate layer so as to radiate an electromagnetic wave in a direction in which one surface of the substrate layer is oriented; and a planar lens configured to convert a quasi-spherical electromagnetic wave radiated from the source antenna into a plane wave. The planar lens may include: a first dielectric layer including a first metasurface including multiple first unit cells formed of a conductive material, the first dielectric layer being disposed to face the source antenna; and a second dielectric layer including a second metasurface including multiple second unit cells formed of a conductive material, the second dielectric layer being disposed to face the source antenna, with the first dielectric layer interposed therebetween.

Among the first unit cells, the refractive index of a first unit cell, which is positioned in a direction of an angle φ with respect to a normal passing through the radiating conductor when viewed from the radiating conductor, satisfies the conditional expression below.

$$n(\phi) = n(0) - \frac{\sqrt{d^2 + (d\tan\phi)^2} - d}{t} \quad \text{Conditional Expression}$$

Here, "n(φ)" may be the refractive index of the first unit cell positioned in the direction of the angle φ, "n(0)" may be the refractive index of a first unit cell positioned on the normal together with the radiating conductor, "d" may be the distance between the substrate layer and the first dielectric layer, and "t" may be the thickness including the thickness of each of the first dielectric layer and the second dielectric layer and the distance between the first dielectric layer and the second dielectric layer.

According to various embodiments, among the first unit cells, the refractive index of a first unit cell, which is positioned in the direction of an angle φ with respect to a normal passing through the radiating conductor when viewed from the radiating conductor, satisfies the following conditional expression.

$$n(\phi) = \frac{1}{k_0 t}\left[\mathrm{Re}\left\{\ln\left(X \pm j\sqrt{1-X^2}\right)\right\} - j\mathrm{Im}\left\{X \pm j\sqrt{1-X^2}\right\}\right] \quad \text{Conditional Expression}$$

Here, "$k_0$" is a wavenumber calculated based on an operating frequency f and the speed of light c, and is $$k_0 = \frac{2\pi f}{c},$$

and "X" is a value calculated based on an S-parameter of the first unit cell, and is $$X = \frac{1}{2S_{21}(1 - S_{11}^2 + S_{21}^2)}.$$

According to various embodiments, the substrate layer may have a circular or square shape, and when the diameter or the length of the side of the substrate layer is D, the distance d between the substrate layer and the planar lens may satisfy the conditional expression below.

$$2 \le D/d \le 3 \qquad \text{Conditional Expression}$$

According to various embodiments, the first metasurface may be disposed to face the source antenna, and the second metasurface may be disposed to face away from the first metasurface.

According to various embodiments, the radiating conductor may include at least one of a microstrip patch antenna structure, a slot antenna structure, a dipole antenna structure, and a standard horn antenna structure.

According to various embodiments, the first unit cell or the second unit cell may include a first conductor pattern and a second conductor pattern formed to surround at least a portion of a region in which the first conductor pattern is formed.

According to various embodiments, the second conductor pattern may be formed in a closed curve shape surrounding the region in which the first conductor pattern is formed.

According to various embodiments, the second conductor pattern may include at least one slot and at least one conductor portion, and the slot and the conductor portion may be arranged along a closed curve trajectory surrounding the first conductor pattern.

In the foregoing detailed description, specific embodiments of the disclosure have been described. However, it will be evident to a person ordinarily skilled in the art that various modifications may be made without departing from the scope of the disclosure.

What is claimed is:

1. An antenna device comprising:

a source antenna comprising a substrate layer and a radiating conductor disposed on the substrate layer so as to radiate an electromagnetic wave in a direction in which one surface of the substrate layer is oriented; and a planar lens configured to convert a quasi-spherical electromagnetic wave radiated from the source antenna into a plane wave, wherein the planar lens comprises:

a first dielectric layer comprising multiple first unit cells including a conductive material, the first dielectric layer being disposed to face the source antenna; and a second dielectric layer comprising multiple second unit cells including a conductive material, the second dielectric layer being disposed to face the source antenna, with the first dielectric layer interposed therebetween.

2. The antenna device of claim 1, wherein the planar lens further comprises an air gap formed between the first dielectric layer and the second dielectric layer.

3. The antenna device of claim 1, wherein the first unit cells are disposed on a surface of the first dielectric layer that faces the source antenna so as to form a metasurface.

4. The antenna device of claim 1, wherein the second unit cells are disposed on a surface of the second dielectric layer that faces away from the source antenna so as to form a metasurface.

5. The antenna device of claim 1, wherein each of the second unit cells is disposed to correspond to one of the first unit cells.

6. The antenna device of claim 1, wherein among the first unit cells, a refractive index of a first unit cell, which is positioned in a direction of an angle φ with respect to a normal passing through the radiating conductor when viewed from the radiating conductor, satisfies Expression 1 below:

$$n(\phi) = n(0) - \frac{\sqrt{d^2 + (d\tan\phi)^2} - d}{t}, \qquad \text{Expression 1}$$

wherein "n(φ)" is the refractive index of the first unit cell positioned in the direction of the angle φ, "n(0)" is a refractive index of a first unit cell positioned on the normal together with the radiating conductor, "d" is a distance between the substrate layer and the first dielectric layer, and "t" is a thickness including a thickness of each of the first dielectric layer and the second dielectric layer and a distance between the first dielectric layer and the second dielectric layer.

7. The antenna device of claim 6, wherein among the first unit cells, the refractive index of the first unit cell, which is positioned in the direction of the angle φ with respect to the normal passing through the radiating conductor when viewed from the radiating conductor, satisfies Expression 2 below:

$$n(\phi) = \frac{1}{k_0 t}\left[\mathrm{Re}\left\{\ln\left(X \pm j\sqrt{1 - X^2}\right)\right\} - j\mathrm{Im}\left\{X \pm j\sqrt{1 - X^2}\right\}\right], \qquad \text{Expression 2}$$

wherein "k0" is a wavenumber calculated based on an operating frequency f and a speed of light c, and is $$k_0 = \frac{2\pi f}{c},$$

"X" is a value calculated based on an S-parameter of the first unit cell, and is $$X = \frac{1}{2S_{21}(1 - S_{11}^2 + S_{21}^2)}.$$

8. The antenna device of claim 1, wherein at least some of the first unit cells have a phase different from those of remaining first unit cells.

9. The antenna device of claim 8, wherein, in an orthogonal coordinate system, which is formed in a plane in which the first unit cells are arranged, and at an origin of which a first unit cell serving as a reference is located, a first unit cell positioned at a distance x from the origin in a horizontal-axis direction and a distance y from the origin in a vertical-axis direction has a phase that satisfies Expression 3 below, and the first unit cell serving as a reference is positioned on a normal passing through the radiating conductor.

$$\Phi(x, y) = \frac{2\pi}{\lambda}\left(\sqrt{x^2 + y^2 + d^2} - d\right) + \Phi_0, \quad \text{Expression 3}$$

wherein "Φ(x, y)" is a phase shift angle of the first unit cell positioned at the distance x and the distance y from the origin, "λ" is a wavelength of an operating frequency, "d" is a distance between the substrate layer and the first dielectric layer, and "Φ0" is a phase shift angle of the first unit cell serving as a reference.

10. The antenna device of claim 1, wherein the radiating conductor comprises at least one of a microstrip patch antenna structure, a slot antenna structure, a dipole antenna structure, and a standard horn antenna structure.

11. The antenna device of claim 1, wherein the substrate layer has a circular or square shape, and when a diameter or a length of a side of the substrate layer is D, a distance d between the substrate layer and the planar lens satisfies Expression 4 below:

$$2 \le D/d \le 3 \quad \text{Conditional Expression 4.}$$

12. An antenna device comprising:

a source antenna comprising a substrate layer and a radiating conductor disposed on the substrate layer so as to radiate an electromagnetic wave in a direction in which one surface of the substrate layer is oriented; and a planar lens configured to convert a quasi-spherical electromagnetic wave radiated from the source antenna into a planar wave, wherein the planar lens comprises:

a first dielectric layer comprising a first metasurface comprising multiple first unit cells including a conductive material, the first dielectric layer being disposed to face the source antenna; and a second dielectric layer comprising a second metasurface comprising multiple second unit cells including a conductive material, the second dielectric layer being disposed to face the source antenna, with the first dielectric layer interposed therebetween, and wherein, among the first unit cells, a refractive index of a first unit cell, which is positioned in the direction of the angle φ with respect to a normal passing through the radiating conductor when viewed from the radiating conductor, satisfies Expression 5 below:

$$n(\phi) = n(0) - \frac{\sqrt{d^2 + (d\tan\phi)^2} - d}{t}, \quad \text{Expression 5}$$

wherein "n(φ)" is the refractive index of the first unit cell positioned in the direction of the angle φ, "n(0)" is a refractive index of a first unit cell positioned on the normal together with the radiating conductor, "d" is a distance between the substrate layer and the first dielectric layer, and "t" is a thickness including a thickness of each of the first dielectric layer and the second dielectric layer and a distance between the first dielectric layer and the second dielectric layer.

13. The antenna device of claim 12, wherein among the first unit cells, a refractive index of the first unit cell, which is positioned in a direction of an angle φ with respect to a normal passing through the radiating conductor when viewed from the radiating conductor, satisfies Expression 6 below:

$$n(\phi) = \frac{1}{k_0 t}\left[\mathrm{Re}\left\{\ln\left(X \pm j\sqrt{1 - X^2}\right)\right\} - j\mathrm{Im}\left\{X \pm j\sqrt{1 - X^2}\right\}\right], \quad \text{Expression 6}$$

wherein "k0" is a wavenumber calculated based on an operating frequency f and a speed of light c, and is $$k_0 = \frac{2\pi f}{c},$$

and "X" is a value calculated based on an S-parameter of the first unit cell, and is $$X = \frac{1}{2S_{21}\left(1 - S_{11}^2 + S_{21}^2\right)}.$$

14. The antenna device of claim 13, wherein the substrate layer has a circular or square shape, and when a diameter or a length of a side is D, a distance d between the substrate layer and the planar lens satisfies Expression 7 below:

$$2 \le D/d \le 3 \quad \text{Expression 7}$$

15. The antenna device of claim 14, wherein the first metasurface is disposed to face the source antenna, and the second metasurface is disposed to face away from the first metasurface.

16. The antenna device of claim 15, wherein the radiating conductor comprises at least one of a microstrip patch antenna structure, a slot antenna structure, a dipole antenna structure, and a standard horn antenna structure.

17. The antenna device of claim 12, wherein the first unit cell or the second unit cell comprises:

a first conductor pattern; and a second conductor pattern formed to surround at least a portion of a region in which the first conductor pattern is formed.

18. The antenna device of claim 17, wherein the second conductor pattern is formed in a closed curve shape surrounding the region in which the first conductor pattern is formed.

19. The antenna device of claim 17, wherein the second conductor pattern comprises at least one slot and at least one conductor portion, and the slot and the conductor portion are arranged along a closed curve trajectory surrounding the first conductor pattern.

* * * * *